US008484763B1

(12) United States Patent
Lucas

(10) Patent No.: US 8,484,763 B1
(45) Date of Patent: Jul. 16, 2013

(54) TENNIS BRA POCKET SYSTEM

(76) Inventor: Sharon J. Lucas, Belleair, FL (US)

( * ) Notice: Subject to any disclaimer, the term of this patent is extended or adjusted under 35 U.S.C. 154(b) by 157 days.

(21) Appl. No.: 13/317,959

(22) Filed: Nov. 1, 2011

Related U.S. Application Data

(63) Continuation-in-part of application No. 13/066,822, filed on Apr. 26, 2011.

(51) Int. Cl.
*A41C 3/00* (2006.01)

(52) U.S. Cl.
USPC ..... 2/89; 2/247; 2/251

(58) Field of Classification Search
USPC ..... 2/247–251; 450/89, 36, 54–57
See application file for complete search history.

(56) References Cited

U.S. PATENT DOCUMENTS

| | | | | |
|---|---|---|---|---|
| 5,496,205 | A * | 3/1996 | Lee | 450/89 |
| 7,753,759 | B2 * | 7/2010 | Pintor et al. | 450/89 |
| 8,257,140 | B2 * | 9/2012 | Kenny | 450/89 |
| 2008/0032600 | A1 * | 2/2008 | Updyke | 450/89 |
| 2009/0104845 | A1 * | 4/2009 | Pintor et al. | 450/31 |
| 2009/0209173 | A1 * | 8/2009 | Arledge et al. | 450/39 |

* cited by examiner

*Primary Examiner* — Gloria Hale

(57) ABSTRACT

A strap assembly includes an upper strap and left and right straps. The straps are coupled with respect to each other. A bra had front and rear sections depending from the straps. The bra has spaced arm holes and an upper neck hole and a lower body hole. At least one patch is operatively associated with the bra. The patch has upper and lower edges separated by a height. The patch has parallel left and right edges separated by a width. The patch has a periphery with stitching coupling the left and right and lower edges of the patch to the bra. A linear slit is formed in the patch parallel with, and closely spaced from, the upper edge of the patch.

10 Claims, 3 Drawing Sheets

FIG. 1
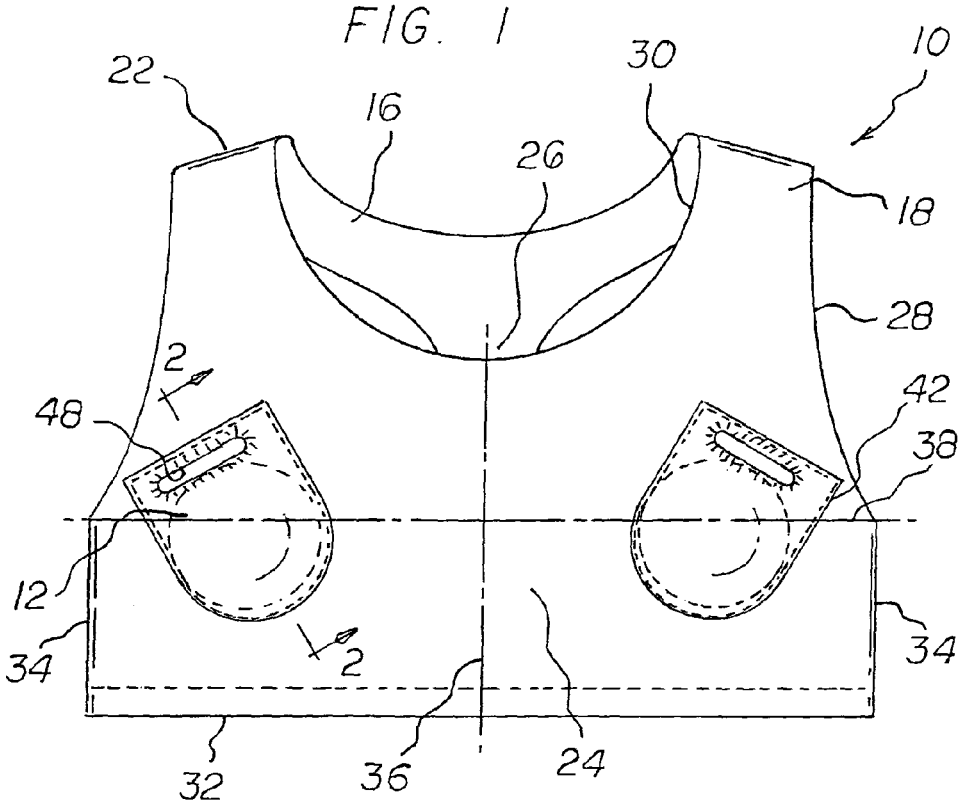
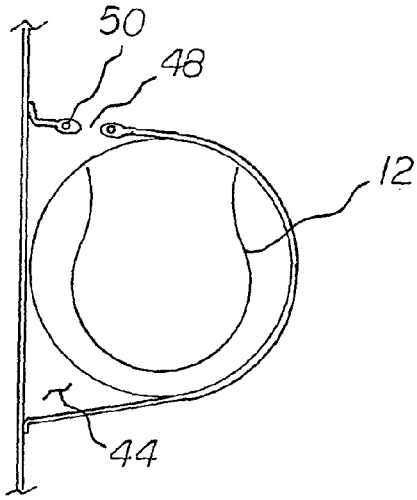
FIG. 2

FIG. 4
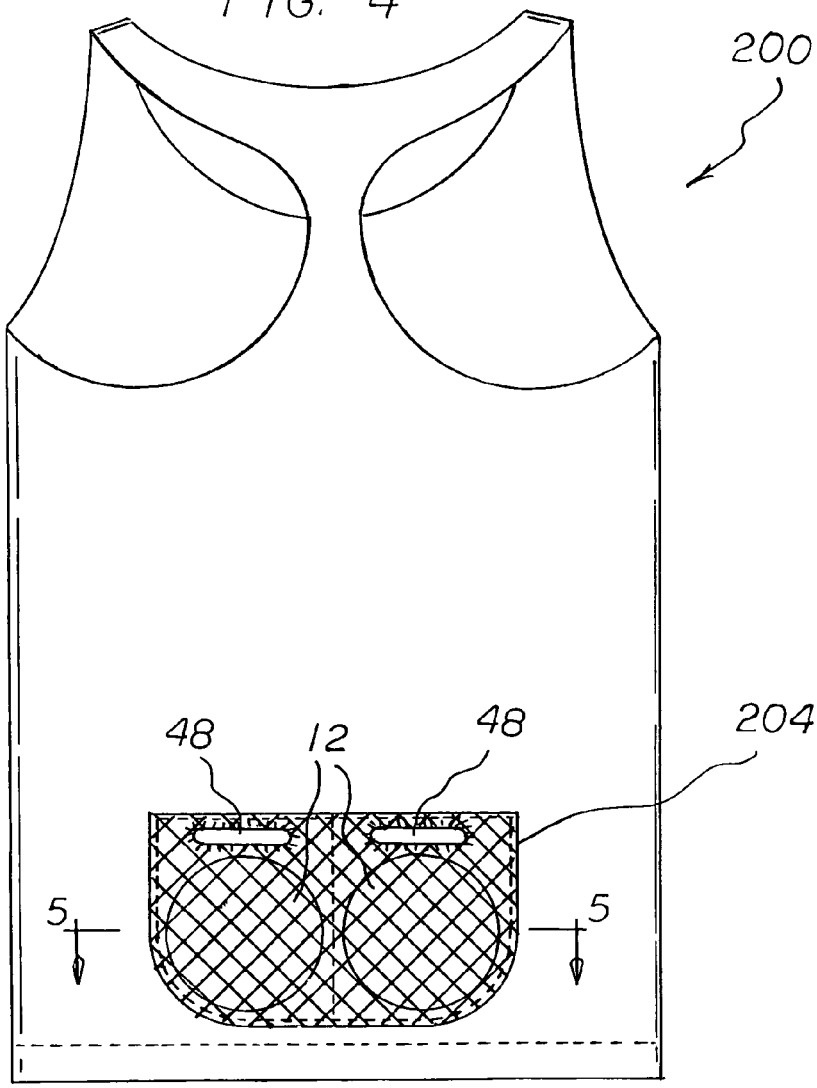
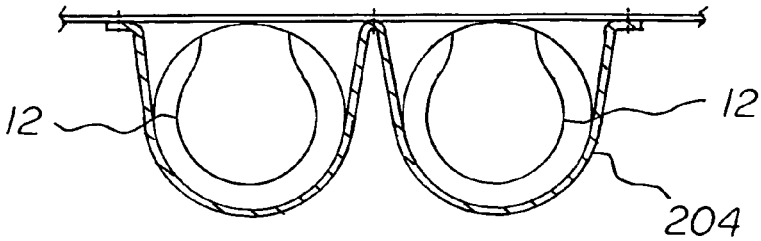
FIG. 5

TENNIS BRA POCKET SYSTEM

RELATED APPLICATION

The present application is a continuation-in-part of pending U.S. patent application Ser. No. 13/066,822, filed Apr. 26, 2011, the priority of which is hereby claimed and the subject matter of which is incorporated herein by reference.

BACKGROUND OF THE INVENTION

Field of the Invention

The present invention relates to a tennis pocket bra system and more particularly pertains to removably receiving tennis balls while providing support and shape to the breasts of a wearer, the receiving and supporting and shaping being done in a safe, convenient and economical manner.

SUMMARY OF THE INVENTION

In view of the disadvantages inherent in the known types of bra systems of known designs and configurations now present in the prior art, the present invention provides an improved tennis pocket bra system. As such, the general purpose of the present invention, which will be described subsequently in greater detail, is to provide a new and improved tennis pocket bra system and method which has all the advantages of the prior art and none of the disadvantages.

To attain this, the present invention essentially comprises a tennis pocket bra system. First provided is a plurality of tennis balls. Each tennis ball has a spherical configuration. Each tennis ball has a periphery. Each tennis ball has a diameter. The diameter is between 2.500 inches and 2.625 inches.

A strap assembly is provided. The strap assembly includes an upper generally horizontal strap. The horizontal strap is positionable around a wearer. The strap assembly includes left and right generally vertical straps. The vertical straps are positionable over the shoulders of the wearer. The horizontal and vertical straps are coupled with respect to each other.

A bra is provided. The bra has a front section. The bra has a rear section. The front and rear sections depend from the horizontal and vertical straps. The front and rear sections are coupled together laterally. In this manner the front and rear sections encompass the torso of the wearer during use. The bra has laterally spaced arm holes. The bra has an upper neck hole. The bra has a lower body hole. The bra has an exterior surface. The bra has an interior surface. The bra has side lines. The side lines depend vertically from beneath the arm holes between the front and rear sections. The bra has a front line. The front line depends vertically from beneath the neck hole midway between the side lines on the front section. The bra has a meridian line. The meridian line is perpendicular to the front and side lines. The meridian line extends between the arm holes at lowermost extents of the arm holes.

Two similarly configured patches are provided. The patches operatively associate with each bra. Each patch has upper and lower edges. The upper and lower edges are separated by a height. The lower edge is curved. Each patch has parallel left and right edges. The left and right edges are separated by a width. Each patch has a periphery. The periphery has stitching. The stitching couples the left and right and lower edges of each patch to the exterior surface of the bra. The patches are laterally spaced closer to the side lines than to the center line. The majority of each patch is beneath the meridian line. The minority of each patch is above the meridian line. Each patch is tilted. The side edges at an angle of between 25 degrees and 35 degrees with respect to the side and center lines. A rectangular chamber is provided. The rectangular chamber is formed between each patch and exterior surface. The chamber is rectangular with a height of between 4 inches and 5 inches. The chamber has a width of between 3.00 inches and 3.5 inches. The patches are fabricated of a stretchable fabric. The fabric is knitted from 95 percent nylon and 5 percent spandex.

Provided last is a linear slit. The linear slit is formed in each patch. The linear slit is provided parallel with, and closely spaced from, the upper edge of each patch. Each slit has a length. The length of each slit is between 75 percent and 95 percent of the width of the chamber. An elastic band is provided. The elastic band is provided within each patch. The elastic band surrounds the slit. The elastic band is adapted to return the slit to a closed orientation. In the closed orientation, the periphery of the elastic band is less than the periphery of the tennis ball. In this manner the tennis ball is retained and the slit is allowed to stretch to an enlarged orientation greater than the periphery of the tennis ball. Further in this manner the tennis ball may move into and out of the chamber.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved tennis pocket bra system which has all of the advantages of the prior art bra systems of known designs and configurations and none of the disadvantages.

It is another object of the present invention to provide a new and improved tennis pocket bra system which may be easily and efficiently manufactured and marketed.

It is further object of the present invention to provide a new and improved tennis pocket bra system which is of durable and reliable constructions.

An even further object of the present invention is to provide a new and improved tennis pocket bra system which is susceptible of a low cost of manufacture with regard to both materials and labor, and which accordingly is then susceptible of low prices of sale to the consuming public, thereby making such tennis pocket-bra system economically available to the buying public.

Even still another object of the present invention is to provide a tennis pocket bra system for removably receiving tennis balls while providing support and shape to the breasts of a wearer, the receiving and supporting and shaping being done in a safe, convenient and economical manner.

Lastly, it is an object of the present invention to provide a new and improved tennis pocket bra system. A strap assembly includes an upper strap and left and right straps. The straps are coupled with respect to each other. A bra had front and rear sections depending from the straps. The bra has spaced arm holes and an upper neck hole and a lower body hole. At least one patch is operatively associated with the bra. The patch has upper and lower edges separated by a height. The patch has parallel left and right edges separated by a width. The patch has a periphery with stitching coupling the left and right and lower edges of the patch to the bra. A linear slit is formed in the patch parallel with, and closely spaced from, the upper edge of the patch.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of a pocket bra system constructed in accordance with the principles of the present invention.

FIG. 2 is a cross sectional view taken along line 2-2 of FIG. 1.

FIG. 4 is a rear elevational view of a final alternate embodiment of the invention.

FIG. 5 is a cross sectional view taken along line 5-5 of FIG. 4.

The same reference numerals refer to the same parts throughout the various Figures.

DESCRIPTION OF THE PREFERRED EMBODIMENT

Figure 3:
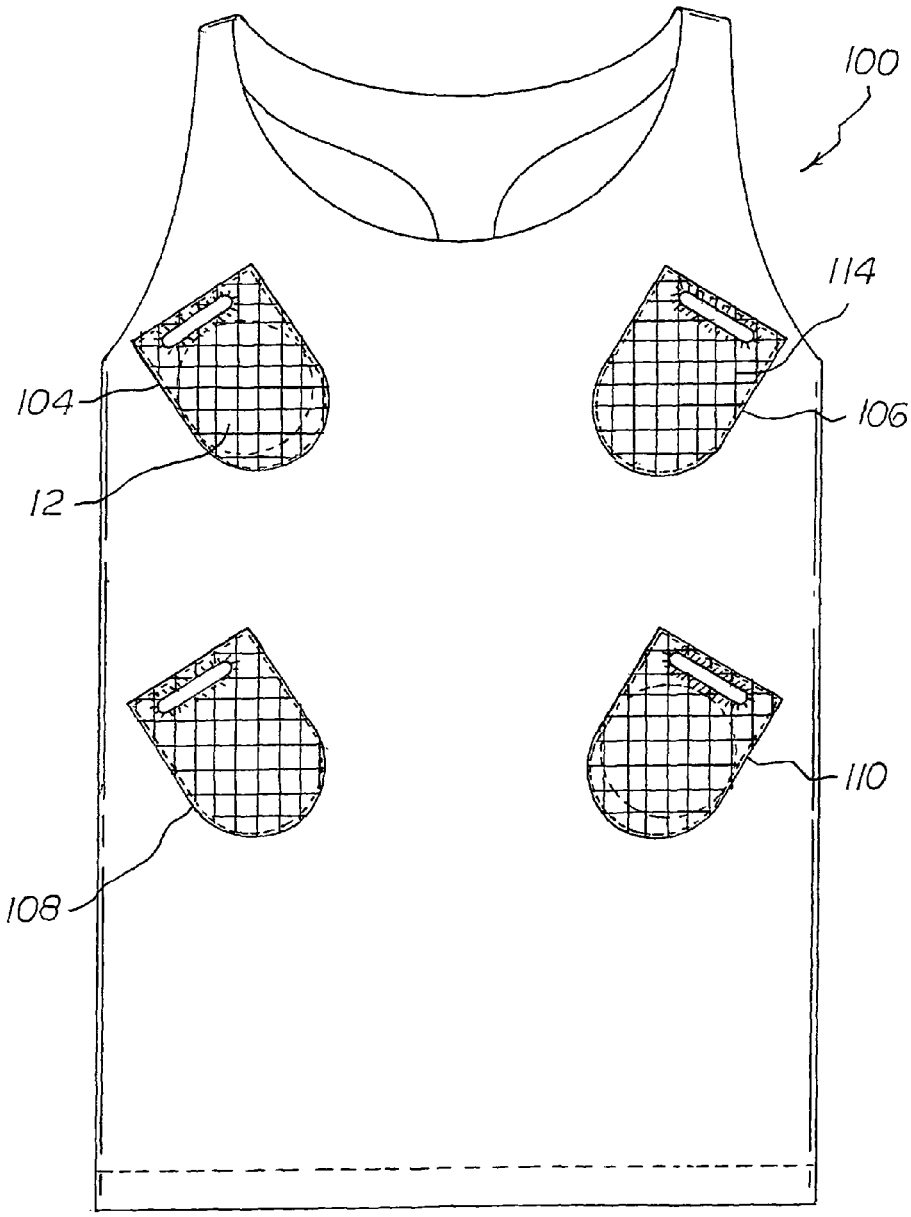
FIG. 3 is a front elevational view of a pocket bra system constructed in accordance with an alternate embodiment of the invention.

With reference now to the drawings, and in particular to FIG. 1 thereof, the preferred embodiment of the new and improved tennis pocket bra system embodying the principles and concepts of the present invention and generally designated by the reference numeral 10 will be described.

The present invention, the tennis pocket bra system 10 is comprised of a plurality of components. Such components in their broadest context include a strap assembly, a bra, and a linear slit. Such components are individually configured and correlated with respect to each other so as to attain the desired objective.

First provided is a plurality of tennis balls 12. Each tennis ball has a spherical configuration. Each tennis ball has a periphery. Each tennis ball has a diameter. The diameter is between 2.500 inches and 2.625 inches.

A strap assembly is provided. The strap assembly includes an upper generally horizontal strap 16. The horizontal strap is positionable around a wearer. The strap assembly includes left and right generally vertical straps 18. The vertical straps are positionable over the shoulders of the wearer. The horizontal and vertical straps are coupled with respect to each other.

A bra 22 is provided. The bra has a front section 24. The bra has a rear section 26. The front and rear sections depend from the horizontal and vertical straps. The front and rear sections are coupled together laterally. In this manner the front and rear sections encompass the torso of the wearer during use. The bra has laterally spaced arm holes 28. The bra has an upper neck hole 30. The bra has a lower body hole 32. The bra has an exterior surface. The bra has an interior surface. The bra has side lines 34. The side lines depend vertically from beneath the arm holes between the front and rear sections. The bra has a front line 36. The front line depends vertically from beneath the neck hole midway between the side lines on the front section. The bra has a meridian line 38. The meridian line is perpendicular to the front and side lines. The meridian line extends between the arm holes at lowermost extents of the arm holes.

Two similarly configured patches 42 are provided. The patches operatively associate with each bra. Each patch has upper and lower edges. The upper and lower edges are separated by a height. The lower edge is curved. Each patch has parallel left and right edges. The left and right edges are separated by a width. Each patch has a periphery. The periphery has stitching. The stitching couples the left and right and lower edges of each patch to the exterior surface of the bra. The patches are laterally spaced closer to the side lines than to the center line. The majority of each patch is beneath the meridian line. The minority of each patch is above the meridian line. Each patch is tilted. The side edges at an angle of between 25 degrees and 35 degrees with respect to the side and center lines. A rectangular chamber 44 is provided. The rectangular chamber is formed between each patch and exterior surface. The chamber is rectangular with a height of between 4 inches and 5 inches. The chamber has a width of between 3.00 inches and 3.5 inches. The patches are fabricated of a stretchable fabric. The fabric is knitted from 95 percent nylon and 5 percent spandex.

Provided last is a linear slit 48. The linear slit is formed in each patch. The linear slit is provided parallel with, and closely spaced from, the upper edge of each patch. Each slit has a length. The length of each slit is between 75 percent and 95 percent of the width of the chamber. An elastic band 50 is provided. The elastic band is provided within each patch. The elastic band surrounds the slit. The elastic band is adapted to return the slit to a closed orientation. In the closed orientation, the periphery of the elastic band is less than the periphery of the tennis ball. In this manner the tennis ball is retained and the slit is allowed to stretch to an enlarged orientation greater than the periphery of the tennis ball. Further in this manner the tennis ball may move into and out of the chamber.

Reference is now made to the alternate embodiment 100 of FIG. 3. The patches are fabricated in an open mesh 106 configuration.

The at least one patch includes four patches 104. Two laterally spaced upper patches are provided. Two laterally spaced lower patches.

Reference is now made to the final alternate embodiment 200 of FIGS. 4 and 5. In such system, the at least one patch includes an enlarged patch 204 positioned on the rear panel midway between the left and right edges and entirely below the arm holes. The enlarged patch has aligned horizontal slots 48 and a vertical line of stitching midway between the slots to form two chambers. Each chamber is of sufficient size to releasably hold a tennis ball 12.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A bra pocket system comprising:

a strap assembly including an upper strap and left and right straps, the straps integrally formed with each other;

a bra having front and rear sections depending from the straps, the bra having spaced arm holes and an upper neck hole and a lower body hole;

at least one patch operatively associated with the bra, the patch having upper and lower edges separated by a height, the patch having parallel left and right edges separated by a width, the patch having a periphery with stitching coupling the left and right and lower edges of the patch to the bra; and a linear slit formed in the patch parallel with, and closely spaced from, the upper edge of the patch.

2. The system as set forth in claim 1 wherein the bra has side line reference points depending vertically from beneath the arm holes between the front and rear sections, the bra having a front line reference point depending vertically from beneath the neck hole midway between the side line reference points on the front section, the bra having a meridian line reference point perpendicular to the front and side line reference points and extending between the arm holes at lowermost extents of the arm holes, the patch being at an angle of between 25 and 35 degrees with respect to the side line reference points and front line reference point.

3. The system as set forth in claim 2 wherein the majority of the patch is located beneath the meridian line reference point and the minority of each patch being above the meridian line reference point.

4. The system as set forth in claim 1 wherein the bra includes two patches laterally spaced from the front line reference point.

5. The system as set forth in claim 1 wherein the bra includes two patches longitudinally spaced one above the other.

6. The system as set forth in claim 1 wherein the patches are fabricated of an elastic fabric knitted from 95 percent nylon and 5 percent spandex.

7. The system as set forth in claim 1 wherein the patches are fabricated in an open mesh configuration.

8. The system as set forth in claim 3 wherein the at least one patch includes four patches, two laterally spaced upper patches and two laterally spaced lower patches.

9. The system as set forth in claim 1 wherein the at least one patch includes a patch positioned on the rear panel midway between the left line reference point and right line reference point and entirely below the arm holes, the patch having aligned horizontal slots (48) and a vertical line of stitching midway between the slots to form two chambers.

10. A tennis bra pocket system (10) for removably receiving tennis balls while providing support and shape to the breasts of a wearer, the system comprising, in combination:

a strap assembly including an upper generally horizontal strap (16) positionable around a wearer, the strap assembly including left and right generally vertical straps positionable over the shoulders of the wearer, the horizontal strap and left and right vertical straps integrally formed with each other;

a bra having a front section and a rear section, the front and rear sections depending from the horizontal and vertical straps and integrally formed laterally to encompass the torso of the wearer during use, the bra having laterally spaced arm holes and an upper neck hole forwardly of the horizontal strap and a lower body hole, the bra having an exterior surface and an interior surface, the bra having side line reference points depending vertically from beneath the arm holes between the front and rear sections, the bra having a front line reference point depending vertically from beneath the neck hole midway between the side line reference points on the front section, the bra having a meridian line reference point perpendicular to the front line reference point and side line reference points and extending between the arm holes at lowermost extents of the arm holes;

two similarly configured patches (42) operatively associated with each bra, each patch having upper and lower edges separated by a height, the lower edge being curved, each patch having parallel left and right edges separated by a width, each patch having a periphery with stitching coupling the left and right and lower edges of each patch to the exterior surface of the bra, the patches being laterally spaced closer to the side line reference points than to the front line reference point, the majority of each patch being beneath the meridian line reference point and the minority of each patch being above the meridian line reference point, each patch being tilted with the side edges at an angle of between 25 degrees and 35 degrees with respect to the side reference lines and front reference line, a rectangular chamber (44) formed between each patch and exterior surface, the chamber being rectangular with a height of between 4 inches and 5 inches, the chamber having a width of between 3.00 inches and 3.5 inches, the patches being fabricated of a stretchable fabric knitted from 95 percent nylon and 5 percent spandex; and a linear slit (48) formed in each patch parallel with, and closely spaced from, the upper edge of each patch, each slit having a length between 75 percent and 95 percent of the width of the chamber, an elastic band 50 within each patch surrounding the slit adapted to return the slit to a closed orientation with a periphery less than the periphery of a tennis ball for tennis ball retention and to allow the slit to stretch to an enlarged orientation greater than the periphery of the tennis ball for movement of the tennis ball into and out of the chamber.

* * * * *